US009388802B2

(12) United States Patent
Lefebvre

(10) Patent No.: US 9,388,802 B2
(45) Date of Patent: Jul. 12, 2016

(54) DEVICE FOR DETECTING BREAKAGE OF A DIAPHRAGM IN A HYDRAULICALLY-ACTUATED PUMP, A METHOD OF MOUNTING SUCH A DEVICE ON A PUMP, AND A PUMP FITTED WITH SUCH A DEVICE

(71) Applicant: MILTON ROY EUROPE, Pont-Saint-Pierre (FR)

(72) Inventor: Remy Lefebvre, Radepont (FR)

(73) Assignee: Milton Roy Europe, Pont-Saint-Piere (FR)

( * ) Notice: Subject to any disclaimer, the term of this patent is extended or adjusted under 35 U.S.C. 154(b) by 345 days.

(21) Appl. No.: 13/743,736

(22) Filed: Jan. 17, 2013

(65) Prior Publication Data

US 2013/0183172 A1 Jul. 18, 2013

(30) Foreign Application Priority Data

Jan. 17, 2012 (FR) ..... 12 50454

(51) Int. Cl.

| | |
|---|---|
| ***F04B 43/02*** | (2006.01) |
| ***F04B 43/00*** | (2006.01) |
| ***F04B 43/06*** | (2006.01) |
| ***F04B 43/067*** | (2006.01) |

(52) U.S. Cl.

CPC ..... *F04B 43/02* (2013.01); *F04B 43/009* (2013.01); *F04B 43/0081* (2013.01); *F04B 43/06* (2013.01); *F04B 43/067* (2013.01); *Y10T 29/49229* (2015.01)

(58) Field of Classification Search

CPC ... F04B 43/067; F04B 43/0081; F04B 43/009

USPC ..... 417/63, 383, 395; 92/86, 96

See application file for complete search history.

(56) References Cited

U.S. PATENT DOCUMENTS

| | | | | |
|---|---|---|---|---|
| 4,966,190 | A * | 10/1990 | Geisinger | 137/613 |
| 5,188,515 | A * | 2/1993 | Horn | 417/63 |
| 5,244,360 | A * | 9/1993 | Lefebvre | 417/383 |
| 5,435,337 | A * | 7/1995 | Kemp | 137/220 |
| 6,468,056 | B1 * | 10/2002 | Murakoshi | 417/395 |
| 7,654,801 | B2 | 2/2010 | Spude | |
| 2005/0115402 | A1 * | 6/2005 | Hembree | 92/96 |
| 2011/0280747 | A1 * | 11/2011 | Lefebvre | 417/395 |

FOREIGN PATENT DOCUMENTS

| | | |
|---|---|---|
| DE | 24 06 838 A1 | 8/1975 |
| EP | 1 801 417 A1 | 6/2007 |
| FR | 2 533 636 A1 | 3/1984 |

* cited by examiner

*Primary Examiner* — Justin Jonaitis
*Assistant Examiner* — Stephen Mick
(74) *Attorney, Agent, or Firm* — Muncy, Geissler, Olds & Lowe, P.C.

(57) ABSTRACT

A device for detecting breaks in a diaphragm of a hydraulically-actuated pump includes a body (21) in which a first chamber (22) is formed, a duct (23) connecting the first chamber to a second end of the body, a check valve (24) arranged in the duct to pass fluid from the second end towards the first chamber, a piston (26) having a first portion (27) that co-operates in sealed manner with the first chamber and that has a hole passing therethrough of diameter greater than the diameter of a free ball (25) of the check valve, and a second portion (33) that is suitable for co-operating in sealed manner with the first portion to form a closed end of the piston. A method of mounting such a device on a pump, and a pump fitted with such a device, are also provided.

10 Claims, 3 Drawing Sheets

DEVICE FOR DETECTING BREAKAGE OF A DIAPHRAGM IN A HYDRAULICALLY-ACTUATED PUMP, A METHOD OF MOUNTING SUCH A DEVICE ON A PUMP, AND A PUMP FITTED WITH SUCH A DEVICE

The invention relates to a device for detecting breakage of a diaphragm in a hydraulically-actuated pump. The invention also provides a method of mounting such a device on a pump, and a pump fitted with such a device.

BACKGROUND OF THE INVENTION

In preferred manner, hydraulically-actuated pumps include at least two diaphragms. It is possible in simple manner to detect that one of the two diaphragms has broken by monitoring the pressure that exists in the space between the two diaphragms.

Hydraulically-actuated diaphragm pumps are thus known that have a composite diaphragm made up of two thin diaphragms with a thick intermediate diaphragm in the form of an elastically deformable dome. The pump has a duct formed in the thickness of the intermediate diaphragm with one end opening out to the outside of the pump and one end connected to at least one drain channel. The drain channel is also provided in the thickness of the pump diaphragm to connect the duct to the spaces that extend between each of the faces of the intermediate diaphragm and the thin diaphragm facing it. Usually, a device for detecting a breakage of a diaphragm is implemented at the outlet from the duct in the intermediate diaphragm.

Nevertheless, it is found that the thin diaphragms are not always perfectly fitted on the intermediate diaphragm. Unfortunately, the presence of air in the space between each thin diaphragm and the intermediate diaphragm greatly degrades the performance of the pump. This drawback is made even worse for a low-flowrate pump.

It is therefore appropriate to evacuate the air that is held captive in this way between the thin diaphragms and the intermediate diaphragm. Various degassing processes are known for bleeding off this air during a stage of putting the pump into operation.

An example of such a degassing process consists in a first step in using a syringe, for example to inject oil into the duct in the intermediate diaphragm. The oil then fills the drain channel and the space between the thin diaphragms and the pump diaphragm.

In a second step, the syringe is used to apply suction to the oil and thus entrain some of the air that was trapped between the thin diaphragms and the intermediate membrane.

In a third step, the detection device is mounted on the pump and the pump is set into operation with progressively increasing load so as to have the consequence of expelling the air that still remains between the thin diaphragms and the intermediate diaphragm under the effect of the suction that exists on either side of the composite diaphragm.

Nevertheless, such a degassing process is found to be lengthy and difficult to perform.

In order to mitigate that drawback, it is known to install an automatic degassing system at the outlet from the duct in the intermediate diaphragm, with this being done before installing the device for detecting breakage of a diaphragm at that location. Nevertheless, such a system is found to be extremely expensive and complex in use.

OBJECT OF THE INVENTION

An object of the invention is to propose means for improving the process for degassing a hydraulically-actuated pump.

BRIEF SUMMARY OF THE INVENTION

To this end, the invention provides a device for detecting a break in a diaphragm of a hydraulically-actuated pump, the device comprising:

- a hollow body in which a first chamber is formed at a first end of the body, a duct connecting the first chamber to a second end of the body; and
- a check valve arranged in the duct to pass fluid from the second end of the body towards the first chamber.

According to the invention, the device comprises a piston mounted to move in translation in the hollow body, the piston having a first portion that co-operates in sealed manner with the first chamber and that has a hole passing therethrough of diameter greater than the diameter of a free ball of the check valve, and a second portion that is suitable for co-operating in sealed manner with the first portion to form a closed end of the piston remote from the second end of the body.

It is thus possible from the beginning to arrange the device for detecting a break on a hydraulically-actuated pump and to degas the pump directly by using that device. This considerably simplifies the process of degassing the pump.

In the first step, the device of the invention is arranged on the pump without the free ball of the check valve and without the second portion of the piston. Thereafter, the oil needed for degassing the pump is poured directly through the first portion of the piston.

The oil then escapes towards the pump through the duct in the hollow body.

In a second step, the first portion of the piston is closed, e.g. by means of the second portion of the piston. The piston is then raised and lowered in successive stages within the first chamber, thereby enabling a portion of the air that was trapped in the pump between the diaphragms to be entrained.

In a third step, the second portion of the pump is removed. The free ball of the check valve is inserted into the hole in the first portion so as to come naturally into position on a seat of the check valve. The second portion of the piston is then arranged on the first portion so as to close the end of the piston. The pump is then put into operation with a progressively increasing load so as to have the consequence of expelling the air that is still present in the pump between the diaphragms.

The device of the invention thus makes it possible to perform a stage of filling the pump with the oil, as is needed for degassing, and to perform a degassing stage, in addition to serving to detect breakage of a diaphragm.

Advantageously, by using a single device for filling, degassing, and detection purposes, it is possible to maintain a small amount of suction in the first chamber of the hollow body. A small fraction of the air held captive in the pump between the diaphragms is thus evacuated continuously, thereby increasing the effectiveness of the degassing process performed by the device of the invention.

In a preferred embodiment, a second chamber is provided in the hollow body between the first chamber and the duct, the second chamber having a diameter greater than the diameter of the first portion of the piston.

As a result, once the above-described first and second steps have been performed, the second portion of the piston is withdrawn and the first portion of the piston is lowered to the level of the second chamber. The free ball of the check valve is then inserted in the hole in the first portion so as to come naturally into position on the seat of the check valve. The second portion of the piston is then arranged on the first portion so as to close the end of the piston. The piston is then raised until it co-operates in leaktight manner with the first chamber, thereby having the consequence of establishing suction in the first and second chambers. The air still present in the pump between the diaphragm is thus expelled into said chambers in natural manner. There is no longer any need to interrupt the degassing process by stopping and starting the pump since the air is entrained continuously from the diaphragm to the device of the invention.

As a result, the degassing of the pump by the device of the invention is found to be even more effective.

In even more preferred manner, the piston includes an abutment for co-operating with the first chamber to stop a stroke of the piston before the first portion of the piston penetrates into the second chamber.

As a result, when the piston is raised, the first portion of the piston is kept in sealed contact with the first chamber, thereby enabling the suction in the hollow body to be maintained. Degassing thus takes place continuously without an operator or an additional system being needed to hold the piston in a sealed contact position with the first chamber, thereby further improving the degassing process.

In the prior art, the degassing process is interrupted when an operator considers that the air held captive between the thin diaphragms and the intermediate diaphragm has been expelled entirely. The operator relies on the flow rate of the pump to make this evaluation, and it is found frequently that a plurality of identical pumps put into operation by different operators provide different flow rates depending on the moments at which the operators interrupted the degassing process. Flow rate differences of 10% to 15% have thus been observed. That drawback is made worse with low-flowrate pumps.

With the device of the invention, identical pumps put into operation by different operators provide flow rates that are much closer together, with the degassing process taking place continuously because of the suction maintained in the hollow body. The flow rate differences are then less than 5%.

The invention also provides a method of mounting such a device on a pump, and a pump fitted with such a device.

BRIEF DESCRIPTION OF THE DRAWINGS

The invention can be better understood in the light of the following description of a particular, non-limiting embodiment of the invention.

Reference is made to the accompanying figures, in which.

DETAILED DESCRIPTION OF THE INVENTION

Figure 1:
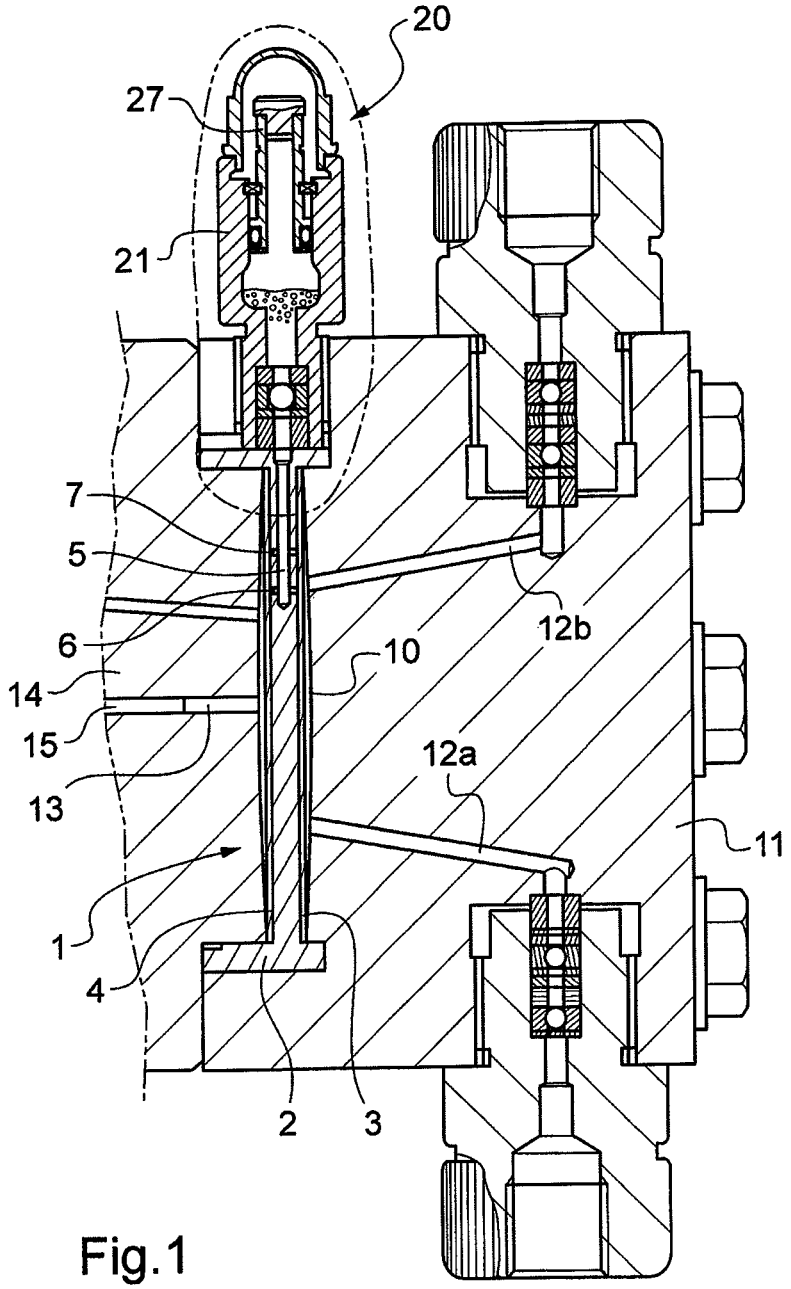
FIG. 1 is a diagrammatic fragmentary section view of a diaphragm pump having a device of the invention.

With reference to FIG. 1, the hydraulically-actuated pump in this example has a composite diaphragm 1 that comprises an intermediate diaphragm 2 between a first thin diaphragm 3 and a second thin diaphragm 4. The intermediate diaphragm 2 is thick and in the form of an elastically deformable dome. The pump has a duct 5 that is arranged in the thickness of the intermediate diaphragm 2 and has a first end opening to the outside of the pump and a second end connected to at least one drain channel. In this example, the second end is connected to a first drain channel 6 and to a second drain channel V. Each drain channel is also provided in the thickness of the intermediate diaphragm, extending transversely relative to the duct 5 in this example, so as to connect the duct 5 to the spaces that extend between each of the faces of the intermediate diaphragm 2 and the facing thin diaphragm.

The pump also has a pump chamber 10 defined in this example both by the first thin diaphragm 3 and by a pump head 11. The pump head 11 has a suction duct 12*a* and a delivery duct 12*b* for a fluid that is to be metered, both of which ducts open out into the pump chamber 10. The pump also has an actuator chamber 13 that is filled with fluid and that is defined in this example by the second thin diaphragm 4, by a pump body 14, and by a front portion of a piston 15 that is movably mounted in said actuator chamber 13 in order to move the fluid in said chamber.

In operation, the composite diaphragm 1 is subjected to the movement of the fluid in the actuator chamber 13 and therefore deforms. This results in a variation of the volume of the actuator chamber 13 that corresponds to the movement of the piston 15 in said actuator chamber 13 and that is transmitted to the pump chamber 10 by the composite diaphragm 1.

Such a pump is well known in the prior art and is not described in greater detail herein. By way of example, such a pump is described in French patent application FR 2 934 332 or indeed in French patent application FR 2 670 537. Such a pump is considered as being a double diaphragm pump because of its two thin diaphragms.

In this example, the pump has a break detector device 20 of the invention that makes it possible to detect breakage of one of the thin diaphragms in the composite diaphragm 1. The device 20 is mounted on the pump at the outlet of the duct 5 in the intermediate diaphragm 2.

Figure 2A:
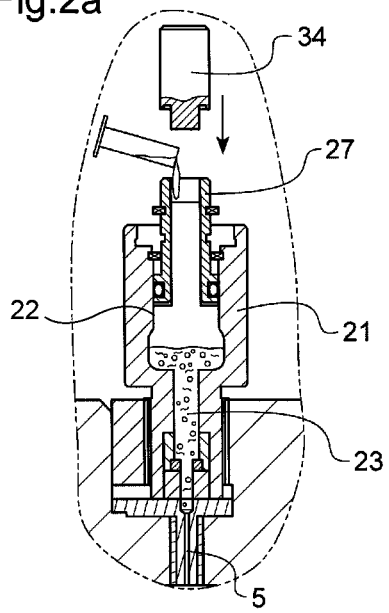
FIGS. 2*a*, 2*b*, 2*c*, 2*d*, 2*e*, and 2*f* are diagrammatic fragmentary section views of the device shown in FIG. 1 during its various stages while being mounted on the pump.
Figure 2B:
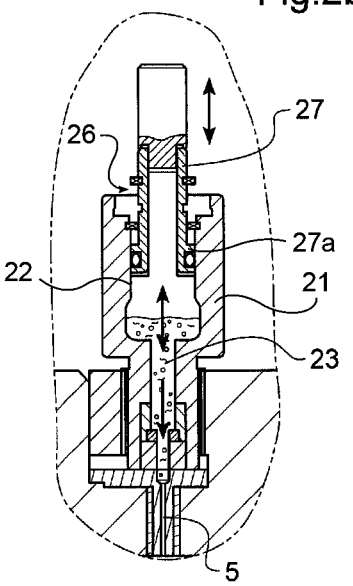
Figure 2C:
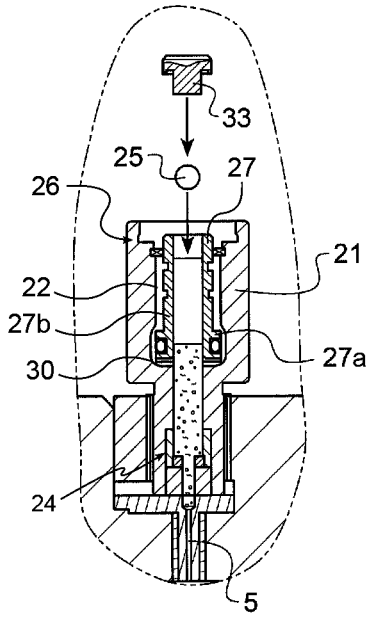
Figure 2D:
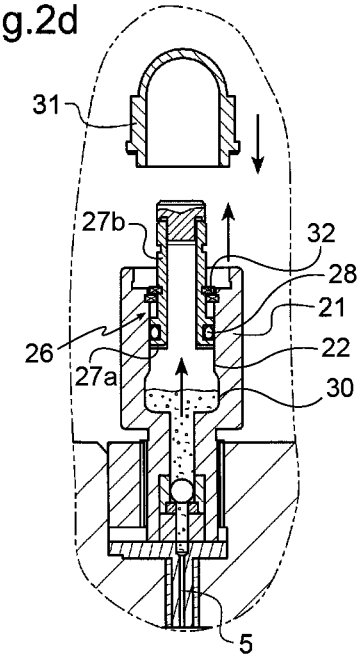
Figure 2E:
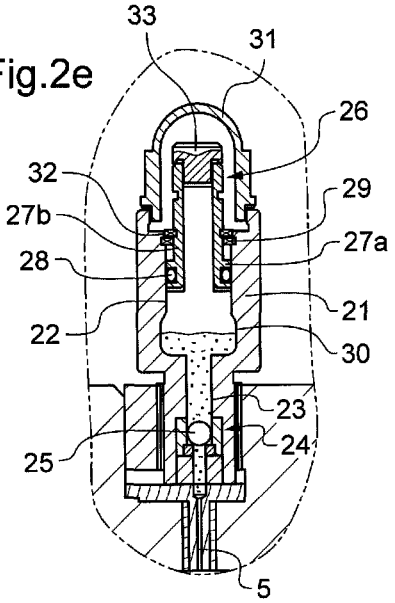

With reference to FIG. 2*e*, said device 20 comprises a hollow body 21 with a first chamber 22 formed therein at a first end of the body 21. A duct 23 connects the first chamber 22 to a second end of the body 21. In this example the device 20 is arranged on the pump so that the duct 23 in the body 21 is connected to the duct 5 in the intermediate diaphragm 2.

The device 20 also has a check valve 24 arranged in the duct 23 so as to pass fluid from the second end of the body towards the first chamber 22. The check valve 24 comprises in conventional manner a free ball 25 resting on a seat formed in the duct 23.

In the invention, the device 20 has a piston 26 mounted to move in translation in the body 21. The piston 26 has a first portion 27 that co-operates in sealed manner with the first chamber 22 and that has a hole passing therethrough of diameter that is greater than the diameter of the free ball 25.

In a preferred embodiment, the first portion 27 is shaped to have a piston head 27*a* and a piston rod 27*b*, the head 27*a* being that part of the first portion 27 that is suitable for co-operating in sealed manner with the first chamber 22. For this purpose, the head 27*a* in this example has a groove that receives a gasket 28 for co-operating with the walls of the first chamber 22.

Preferably, the first end of the body 21 includes a first abutment 29 for stopping a stroke of the piston 26 and thus preventing the head 27*a* of the piston 26 from escaping from the body 21. In this example, the first end of the body 21 has a groove that receives a resilient ring for forming the first abutment 29. In this example the resilient ring co-operates with the head 27*a* of the piston so as to stop the stroke of the piston.

The piston 26 also has a second portion 33 that is suitable for co-operating in sealed manner with the rod 27*b* to form a closed end of the piston 26 remote from the second end of the body.

In a preferred embodiment, a second chamber 30 is provided in the hollow body 21 between the first chamber 22 and the duct 23 in the body 21, the second chamber 30 having a diameter that is greater than the diameter of the first portion 27 of the piston.

Preferably, the rod 27*b* of the piston has a second abutment 32 for stopping the stroke of the piston and preventing the piston head 27*b* from penetrating into the second chamber 30. In this example, the rod 27*b* includes a groove that receives a resilient ring for forming the second abutment 32. The resilient ring forming the second abutment 32 co-operates in this example with the resilient ring forming the first abutment 29 for stopping the stroke of the piston.

Thus, by means of these two abutments, the head 27*b* of the piston is movable in translation solely in the first chamber 22.

The device 20 in this example also includes cover means for covering the hollow body 21, which means are arranged on the first end of the body 21 in order to form a closed top portion of the device 20 remote from the portion of the device 20 that is in contact with the pump. In a particular embodiment, the cover means of the hollow body 21 comprise a transparent cap 31 arranged on the first end of the body 21 to form a top portion of the device 20 remote from the portion of the device 20 that is in contact with the pump, the transparent cap 31 in this example being shaped so as to allow the piston 26 to have a stroke extending as far as the first abutment 29. The second portion 33 of the piston 26 is then preferably colored.

The device 20 is mounted as follows on the pump.

With reference to FIG. 2*a*, the body 21 is mounted on the pump so that the duct 23 in the body 21 is connected in sealed manner to the duct 5 in the intermediate diaphragm 2. The first portion 27 of the piston is then inserted in the body 21 so as to be in sealed contact with the first chamber 22.

In this position, a fluid needed for degassing the pump, e.g. oil, is poured directly through the first portion 27 of the piston. The oil then escapes towards spaces formed between each thin diaphragm and the intermediate diaphragm 2 via the duct 23 and the body 21, the duct 5 in the intermediate diaphragm 2, and the drain channels 6, 7. Oil is preferably poured until it fills a portion of the second chamber 30.

Once the oil has been poured, the hole in the first portion 27 of the piston is closed to form the closed end of the piston 26 remote from the second end of the body 21. In this example, a stopper 34 is arranged on the first portion 27 of the piston to co-operate in sealed manner with the hole in the first portion.

With reference to FIG. 2*b*, the piston 26 is then raised and then lowered in successive stages in the hollow body 21, its head 27*a* always remaining in sealed contact with the wall of the first chamber 22. A fraction of the air present between the thin diaphragms and the intermediate diaphragm 2 is then entrained to the surface of the volume of oil in the second chamber 30 by the pumping caused by the piston 26.

Some of the degassing is thus performed by the device of the invention.

With reference to FIG. 2*c*, the stopper is removed from the first portion 27 of the piston. The resilient ring of the second abutment 32 is preferably removed from the rod 27*b* and the first portion 27 of the piston is preferably lowered so that the head 27 of the first portion comes level with the second chamber 30. The pressure in the first chamber 22 and in the second chamber 30 is then equal to atmospheric pressure.

The free ball 25 is inserted in the hole in the first portion 27 so as to occupy naturally a position on the seat of the check valve 24 merely under gravity. The second portion 33 of the piston is then arranged on the first portion 27 so as to close the end of the piston 26.

With reference to FIG. 2*d*, the piston 26 is then raised until the head 27*a* co-operates in leaktight manner with the first chamber 22.

The pressure that exists in the first chamber 22 and in the second chamber 30 then becomes lower than atmospheric pressure, thereby creating suction in said chambers. The air still present between the thin diaphragms and the intermediate diaphragm is then naturally entrained to the surface of the volume of oil in the second chamber 30 because of this suction.

Advantageously, the degassing of the pump is performed continuously and automatically by the suction maintained in the chambers. The degassing may thus be performed during handling and during transport of the pump to a client, such that by the time the pump is started by the client there is practically no residual air between the thin diaphragms and the intermediate diaphragm. The thin diaphragms are then pressed very closely against the intermediate diaphragm, thereby ensuring that the pump presents good efficiency as soon as it starts.

Advantageously, it is very easy for an operator to tell whether the head 27*a* is still level with the first chamber 22 or whether it is level with the second chamber 30, even if the operator cannot see this visually. When the gasket 28 engages against the walls of the first chamber 22, that generates friction forces and the operator can then feel very clearly resistance to the piston 26 being raised.

The piston 26 is preferably raised until the resilient ring of the second abutment 32 can be put back into place on the rod 27*b*, i.e. until the two abutments co-operate with each other.

The piston 26 is then held in a raised position in which the head 27*a* co-operates in sealed manner with the first chamber 22, the co-operation between the two abutments preventing the head 27*a* from moving down within the second chamber 30. The suction in the first chamber 22 and in the second chamber 30 is thus maintained without there being any need for an operator or an additional system to hold the piston in this raised position.

With reference to FIG. 2*d*, the cap 31 is mounted on the device, once the piston 26 has been raised.

Figure 2F:
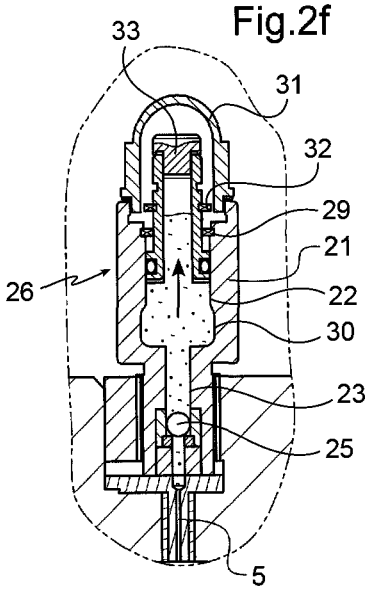

With reference to FIGS. 2*e* and 2*f*, when one of the two thin diaphragms breaks, the oil present between the thin diaphragms 3 and 4 and the intermediate diaphragm 2 and/or the fluid to be metered and/or the fluid filling the actuator chamber 13 is delivered into the drain channel 6, 7 and into the duct 5 in the intermediate diaphragm 2 until it rises into the duct 23 in the device 20. Because of the pressure exerted by the oil and/or the fluid for metering and/or the fluid filling the actuator chamber, the free ball 25 is lifted and the liquid rises into the second chamber 30 from the first chamber 22 and causes the piston to move from the second abutment 32 to the first abutment 29.

The operator can easily detect a diaphragm breakage problem since the colored second portion 33 of the piston 26 is then clearly visible through the transparent cap 31.

The device of the invention makes it possible to perform functions other than detecting a break in one of the diaphragms, such as filling the pump with the oil needed for degassing, and then degassing the pump. The device is particularly adapted to low-flowrate pumps having two diaphragms in which the smallest volume of air trapped between the two thin diaphragms degrades the performance and the accuracy of the pump.

The invention is not limited to the above description, but on the contrary covers any variant coming within the ambit defined by the claims.

In particular, the device of the invention may be arranged on pumps of types other than that described. For example, the device can be arranged on a hydraulically-actuated pump having two diaphragms that are pinched in sealed manner at their periphery onto a stationary structure comprising an annular part interposed between the two diaphragms, an inside space between the two diaphragms being in communication with at least one duct formed in the thickness of the annular part, said duct being connected to the duct of the device of the invention. By way of example, one such pump is described in French patent application FR 2 624 922.

The various parts of the piston may be shaped differently from the shapes described. For example, the first portion 27 could form a piston head and the second portion 33 could form a piston rod.

The body of the device need not include a second chamber 30 between the first chamber 22 and the duct 23 of the device 20. Nevertheless, the degassing of a pump on which the device is mounted would then be less effective in a device without a second chamber, since it would then not be possible to establish suction in the hollow body.

The device does not need a cover means. For example, if a break in a diaphragm is detected visually, the device need not include a transparent cap 31. Preferably, the second portion 33 of the piston 26 is then colored.

Figure 3A:
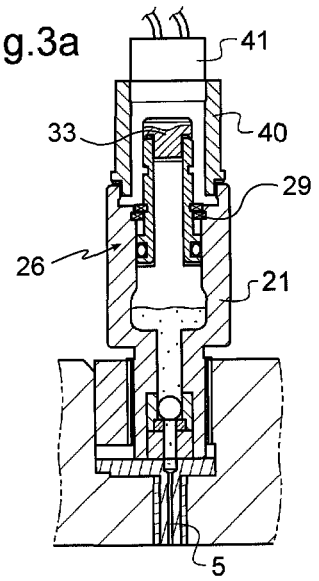
FIGS. 3*a* and 3*b* are fragmentary diagrammatic section views of a device constituting a variant of the invention shown during the same mounting stages as in FIGS. 2*e* and 2*f*.
Figure 3B:
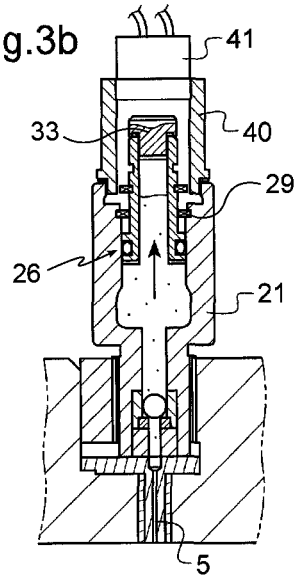

Although a break in a diaphragm in this example is detected visually, the break could be detected electronically. For example, with reference to FIGS. 3*a* and 3*b*, the device includes cover means for the hollow body 21 that comprise a cover 40 arranged on the first end of the body to form a top portion of the device remote from the portion of the device that is in contact with the pump, the cover 40 being shaped to allow the piston 26 to move through a stroke up to the first abutment 29. An inductive sensor 41 is arranged on said cover 40 so as to generate an electromagnetic field in a closed volume defined by the cover 40, the hollow body 21, and the piston 26. The second portion 33 of the piston 26 is then made of an electrically conductive material, e.g. a metal. In the event of one of the diaphragms breaking, the movement of the piston 26 will cause the second portion 33 of the piston to modify the electromagnetic field generated by the inductive sensor, thereby making it possible to identify that the diaphragm has broken.

The cover 40 is preferably transparent. Thus, if the inductive sensor detects a modification in the electromagnetic field it generates, the operator can verify visually whether the piston 26 has or has not moved and thus determine whether or not there is a diaphragm breakage problem.

The various steps of mounting the device 20 on the pump could be different from those described above. In particular, although a stopper 34 is arranged on the first portion 27 of the piston in order to co-operate in sealed manner with the hole in the first portion 27 during the first degassing stage, it would also be possible to arrange the second portion 33 of the piston so that it is capable of co-operating directly in sealed manner with the hole in the first portion 27 during said second degassing stage.

What is claimed is:

1. A device for detecting a break in a diaphragm of a hydraulically-actuated pump, the device being separate from the diaphragm of the hydraulically-actuated pump, the device comprising:

a hollow body (21) in which a first chamber (22) is formed at a first end of the body, a duct (23) connecting the first chamber to a second end of the body and connected to the hydraulically-actuated pump when the device is mounted on the hydraulically-actuated pump; and a check valve (24) arranged in the duct to pass fluid from the second end of the body towards the first chamber;

wherein the device comprises a piston (26) mounted to move in translation in the hollow body, the piston having a first portion (27) that co-operates in sealed manner with the first chamber and that has a hole passing therethrough of diameter greater than the diameter of a free ball (25) of the check valve so that the free ball is able to pass through the piston, and a second portion (33) that is suitable for co-operating in sealed manner with the first portion to form a closed end of the piston remote from the second end of the body.

2. A device according to claim 1, wherein a second chamber (30) is provided in the hollow body (21) between the first chamber (22) and the duct (23), the second chamber having a diameter greater than the diameter of the first portion (27) of the piston.

3. A device according to claim 2, wherein the piston (26) includes an abutment (32) for co-operating with the first chamber (22) to stop a stroke of the piston before the first portion (27) of the piston penetrates into the second chamber (30).

4. A device according to claim 1, including an abutment (29) that is arranged level with the first end of the body (21) and that is designed to co-operate with the piston (26) to stop a stroke of the piston before the first portion (27) of the piston exits completely from the hollow body (21).

5. A device according to claim 1, including cover means for covering the hollow body (21), which means are arranged on the first end of the body (21) to form a closed top portion of the device remote from a bottom portion of the device provided with means for connection to the pump.

6. A device according to claim 5, wherein the cover means of the hollow body (21) comprise a transparent cap (31) arranged on the first end of the body (21), and the second portion (33) of the piston (26) is colored.

7. A device according to claim 1, wherein the first portion (27) is shaped as a piston head (27*a*) and as a piston rod (27*b*), the head being that part of the first portion that is suitable for co-operating in sealed manner with the first chamber (22).

8. A mounting method for mounting the device of claim 1 on a pump, the method comprising the steps of:

arranging the body (21) on the pump;

inserting the first portion (27) of the piston in the body in order to be in sealed contact with the first chamber (22);

pouring a fluid needed for degassing the pump directly through the first portion of the piston;

inserting the free ball (25) in the hole in the first portion; and arranging the second portion (33) of the piston on the first portion.

9. A mounting method according to claim 8, wherein the device includes a second chamber (30) arranged in the hollow body (21) between the first chamber (22) and the duct (23), the second chamber having a diameter greater than the diameter of the first portion (27) of the piston, the method then including the following steps:

lowering the first portion of the piston to the level of the second chamber prior to inserting the free ball (25) of the check valve (24), and arranging the second portion (33) of the piston on the first portion; and raising the piston (26) so that the first portion co-operates in sealed manner with the first chamber.

10. A hydraulically-actuated diaphragm pump including a composite diaphragm (1) having a thick intermediate diaphragm (2) between two thin diaphragms (3, 4), where the thick intermediate diaphragm is thicker than either of the two thin diaphragms, the thick intermediate diaphragm forming an elastically deformable dome, the pump including a duct (5) that is arranged in the thickness of the thick intermediate diaphragm (2) and that has one end opening out to the outside of the pump and one end connected to at least one drain channel (6, 7), the drain channel also being provided in the thickness of the thick intermediate diaphragm (2) in order to connect the duct (5) of the pump to the spaces that extend between each of the faces of the thick intermediate diaphragm 2 and the thin diaphragm facing each of the faces of the thick intermediate diaphragm, the end of the duct that opens to the outside of the pump being connected to the duct (23) of a device according to claim 1.

* * * * *